US006148799A

United States Patent [19]

Leipelt et al.

[11] Patent Number: 6,148,799

[45] Date of Patent: Nov. 21, 2000

[54] INTAKE SYSTEM

[75] Inventors: Rudolf Leipelt, Marbach; Volker Ernst, Sachsenheim, both of Germany

[73] Assignee: Filterwerk Mann & Hummel GmbH, Ludwigsburg, Germany

[21] Appl. No.: 09/125,166

[22] PCT Filed: Dec. 21, 1996

[86] PCT No.: PCT/EP96/05804

§ 371 Date: Nov. 25, 1998

§ 102(e) Date: Nov. 25, 1998

[87] PCT Pub. No.: WO97/30282

PCT Pub. Date: Aug. 21, 1997

[30] Foreign Application Priority Data

Feb. 12, 1996 [DE] Germany ..... 196 04 839

[51] Int. Cl.[7] ..... F02M 37/04

[52] U.S. Cl. ..... 123/469; 123/470

[58] Field of Search ..... 123/470, 468, 123/469, 472

[56] References Cited

U.S. PATENT DOCUMENTS

| | | | |
|---|---|---|---|
| 4,294,215 | 10/1981 | Hans | 123/469 |
| 4,307,693 | 12/1981 | Glockler | 123/469 |
| 4,457,280 | 7/1984 | Hudson | 123/468 |
| 4,539,961 | 9/1985 | Atkins | 123/468 |
| 4,909,220 | 3/1990 | Field | 123/468 |
| 4,991,557 | 2/1991 | DeGrace | 123/468 |
| 5,044,338 | 9/1991 | Shelton | 123/469 |
| 5,056,489 | 10/1991 | Lorraine | 123/468 |
| 5,172,671 | 12/1992 | Peters | 123/468 |
| 5,299,542 | 4/1994 | Hafner | 123/468 |
| 5,301,647 | 4/1994 | Lorraine . | |

FOREIGN PATENT DOCUMENTS

| | | | |
|---|---|---|---|
| 666 417 | 8/1995 | European Pat. Off. . | |
| 34 28 597 | 2/1986 | Germany . | |
| 44 01 013 | 7/1994 | Germany . | |
| 6264844 | 9/1994 | Japan | 123/468 |

*Primary Examiner*—Carl S. Miller

*Attorney, Agent, or Firm*—Evenson, McKeown, Edwards & Lenahan, P.L.L.C.

[57] ABSTRACT

An intake manifold for the supply of air for an internal combustion engine with a fuel distributor, in which the fuel distributor is fixed to the intake manifold through a plug-in, catch or snap connection.

4 Claims, 3 Drawing Sheets

INTAKE SYSTEM

BACKGROUND OF THE INVENTION

In an intake manifold for supplying air to an internal combustion engine, it is necessary also to arrange a fuel distribution tube to feed fuel to the corresponding injection valves. A fuel distributor for fuel injection systems of internal combustion engines is disclosed in WO 90-13740. This fuel distributor is usually a multifunctional component which bears the injection valves; it is also provided with the appropriate electrical connections and has a supply line for the fuel. The fuel distributor is fastened by a screw connection to an intake manifold; the electrical distribution strip is likewise attached by appropriate screw fastening means. If properly secured, such screw fastening is extremely reliable, but the amount of labor involved in it and the cost it involves are disadvantageous.

SUMMARY OF THE INVENTION

It is therefore the object of the invention to provide an intake manifold with a fuel distributor for delivering the fuel to an internal combustion engine, in which the assembly work involved in its installation is considerably reduced. This problem is solved, setting out from the preamble of the main claim, by the characterizing features thereof.

The substantial advantage of the invention is that the fuel distributor is fastened by a plug or catch or snap attachment. Assembly is thus possible without tools and can be automated or performed manually in a simple manner.

The reliability of such attachment is further increased according to a further embodiment of the invention by providing an additional locking element. In one embodiment of the locking element, this comprises a resiliently clamped locking pin. The possibility also exists of providing a self-tapping screw connection or of securing the element directly to the fuel distributor by means of a catch.

To provide a leak-proof connection between the intake manifold and fuel distributor or between the injection valve and fuel distributor, suitable O-rings can be provided.

These and other features of preferred embodiments of the invention will be found not only in the claims but also in the description and the drawings, it being possible for the individual features to be realized individually or together in the form of sub-combinations in the embodiment of the invention and in other fields, and can be advantageous as well as independently patentable embodiments for which protection is hereby claimed.

BRIEF DESCRIPTION OF THE DRAWINGS

The invention is further explained below with reference to working embodiments.

DETAILED DESCRIPTION OF PREFERRED EMBODIMENTS

Figure 1:
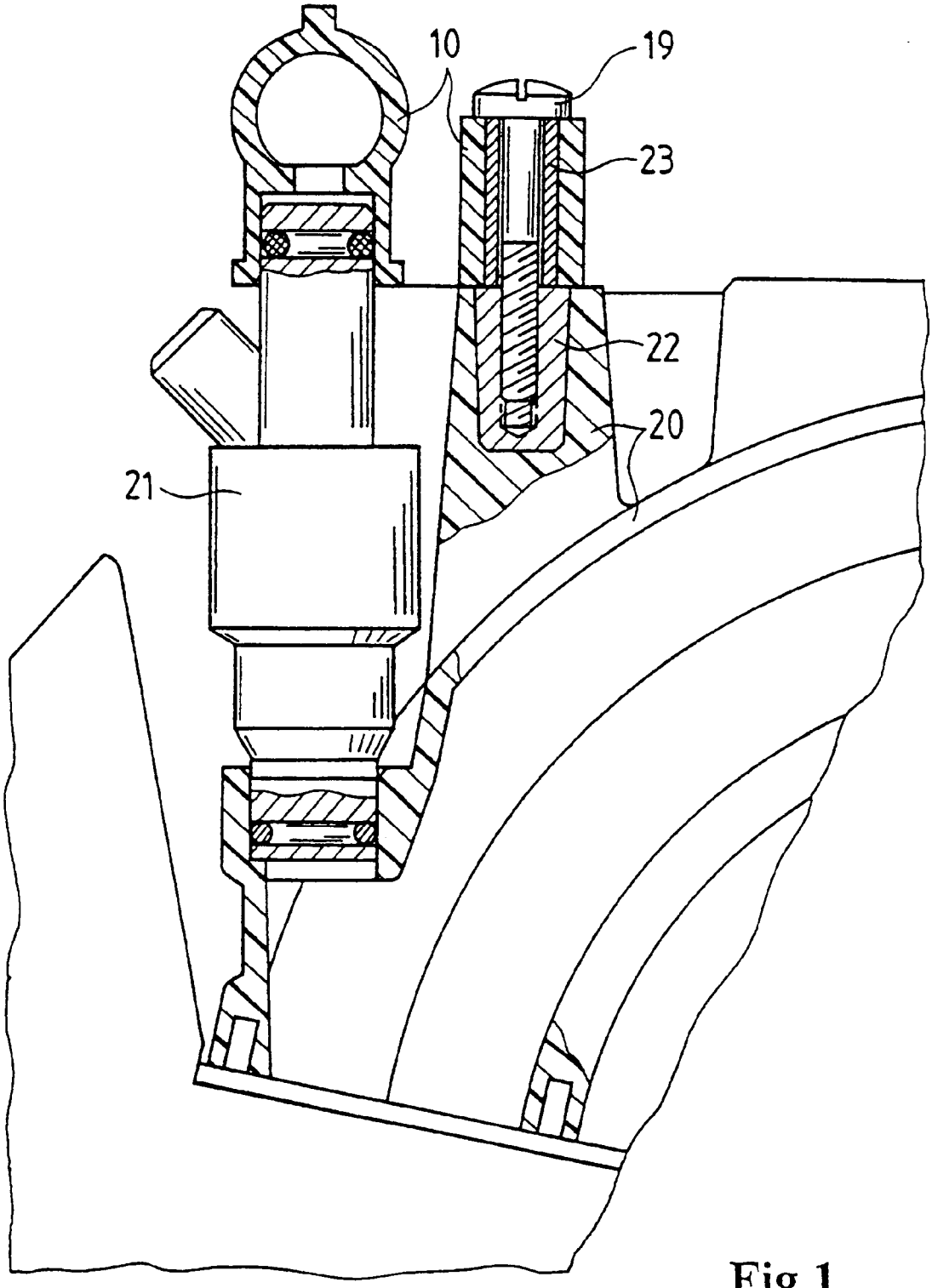
FIG. 1 shows an intake manifold according to the state of the art.

According to FIG. 1 it was known to fasten a distribution tube 10 to an air intake manifold 20 by a screw 19. The injection valve 21 was inserted between the distribution tube 10 and intake manifold 20. This kind of fastening, however, is very complicated because in the case of the intake manifold 20, which usually is composed of synthetic resin, supplemental threaded insert bushings 22 are also required; in addition spacer sleeves 23 are also necessary on the distribution tube, which is made of plastic.

Figure 2:
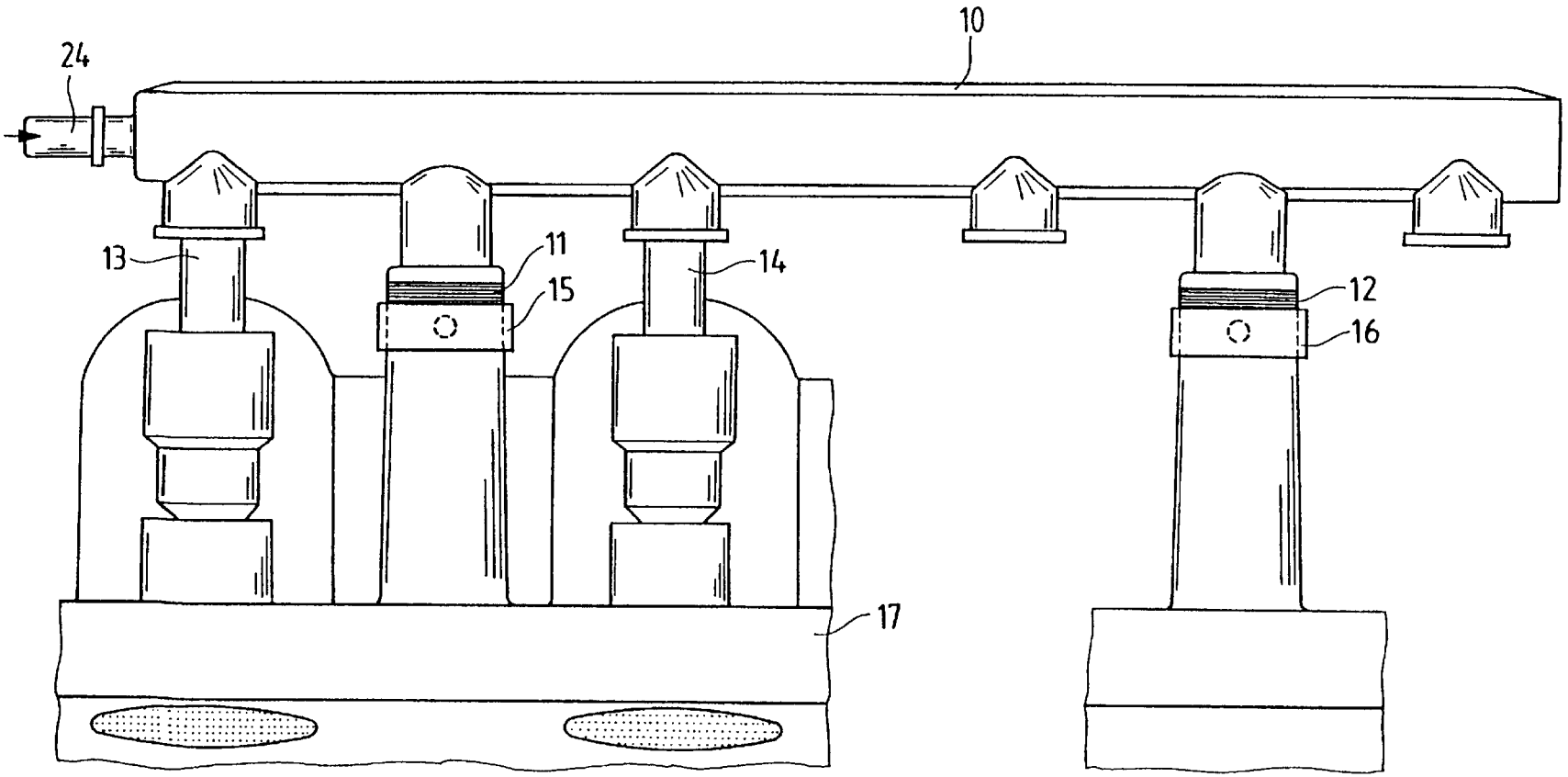
FIG. 2 shows a top plan view of a fuel distributor.

FIG. 2 shows a top plan view of a fuel distributor with an example of a solution according to the invention. The fuel distributor 10 is placed on two connecting elements 11, 12 of the intake manifold 17. Between the fuel distributor and the intake manifold are shown the injection valves 13, 14; spring clips 15, 16 are provided as fasteners. The supply of fuel to the fuel distributor 10 is effected via the connector 24. The illustrated fuel distributor 10 is a backflow-free system.

FIGS. 3*a*–3*i* show different variants of a plug connection.

Figure 3A:
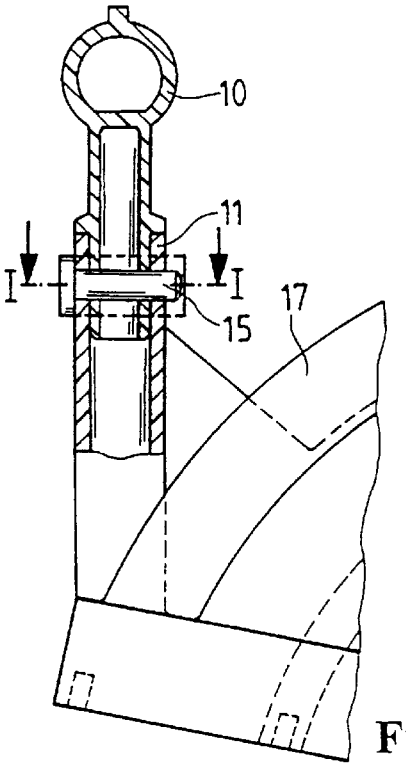
FIGS. 3*a*–3*i* show different variants of a plug connection for a fuel distributor.
Figure 3E:
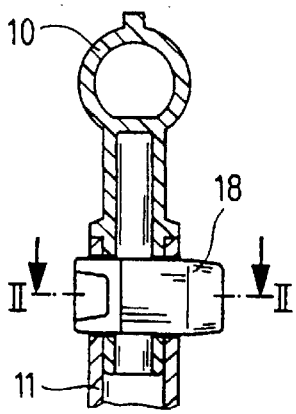
Figure 3F:
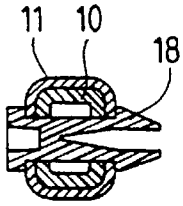
Figure 3B:
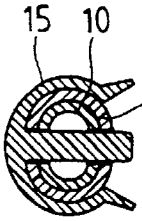

FIGS. 3*a* and 3*b* show a fuel distributor 10 which is plugged onto a connecting element of the intake manifold 17 and held thereon by a securing clamp 15.

Figure 3C:
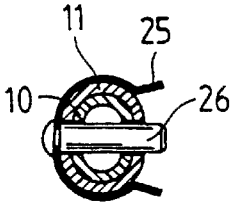

In the case of FIG. 3*c* there is also a securing clamp, but the clamp is not made of synthetic resin as in FIGS. 3*a* and 3*b*, but of spring steel 25 or sheet bronze. The securing pin 26 is riveted to the clamp.

Figure 3D:
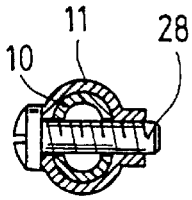

FIG. 3*d* shows a securing element with a self-tapping screw 28.

FIGS. 3*e* (section I—I of FIG. 3*a*) and 3*f* each show a securing pin 18 which likewise constitutes an interlocking fastener for attaching the fuel distributor to the intake manifold and is made, for example, of synthetic resin.

Figure 3G:
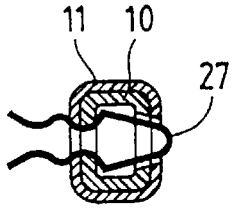

FIG. 3*g* shows a pin element 27 which is made of a strip or wire of spring steel.

FIG. 3*d* shows a securing element with a self-tapping screw 28.

Figure 3H:
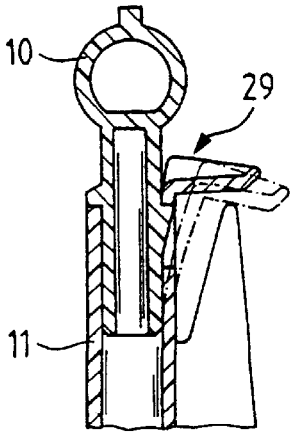
Figure 3I:
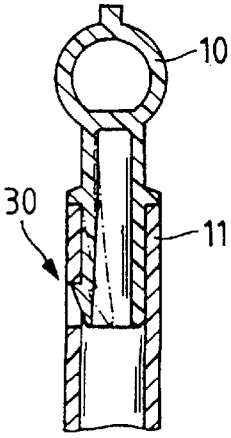

There is also the possibility shown in FIGS. 3*h* and 3*i* of providing a snap or catch element 29, 30, on the connecting element 11. In conjunction with a mating portion on the fuel distributor 10 this also provides a reliable connection of the fuel distributor and intake manifold 17 or the corresponding connecting element 11 of the intake manifold. In the arrangements shown in FIGS. 3*h* and 3*i*, additional securing elements are omitted.

What is claimed is:

1. An intake system for supplying fuel and air to an internal combustion engine, said system comprising an intake manifold for supplying of air to the engine; a fuel distributor for supplying fuel to the engine; at least two connectors for attaching the fuel distributor to the intake manifold; and a plurality of fuel injection valves held in place between the fuel distributor and the intake manifold for introducing measured quantities of fuel from the fuel distributor into air passing through the intake manifold; wherein said connectors each comprise a projection on said fuel distributor, a mating receptacle on said intake manifold in which the projection on the fuel distributor is received, and an integral catch member formed in one piece with one of the projection or the receptacle for locking the projection in the receptacle, said projection and receptacle of each connector being directly interconnected to join said fuel distributor to said intake manifold without additional securing elements, and said connectors fixing said fuel distributor against movement in any direction relative to said intake manifold.

2. An intake system according to claim 1, wherein the catch member of each connector comprises an integral catch element formed in one piece with the receptacle on the intake manifold, said catch element engaging over a shoulder on the projection on the fuel distributor when the fuel distributor is attached to the intake manifold to lock the projection in the receptacle.

3. An intake system according to claim 1, wherein said catch member of each connector comprises an integral catch finger formed in one piece with the projection on the fuel distributor, said catch finger engaging in a recess in the receptacle when the fuel distributor is attached to the intake manifold to lock the projection in the receptacle.

4. An intake system according to claim 3, further comprising an O-ring arranged between each injection valve and said fuel distributor for providing a liquid-tight seal between the fuel distributor and the respective injection valve.

* * * * *